US009731855B2

(12) United States Patent
Zwilling

(10) Patent No.: US 9,731,855 B2
(45) Date of Patent: Aug. 15, 2017

(54) LABELING DEVICE FOR CONTAINERS

(71) Applicant: KHS GmbH, Dortmund (DE)

(72) Inventor: Heinz-Michael Zwilling, Hamm (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 15/216,954

(22) Filed: Jul. 22, 2016

(65) Prior Publication Data

US 2016/0325870 A1 Nov. 10, 2016

Related U.S. Application Data

(63) Continuation of application No. PCT/EP2016/054236, filed on Feb. 29, 2016.

(51) Int. Cl.

| | |
|---|---|
| ***B65C 9/02*** | (2006.01) |
| ***B65C 9/00*** | (2006.01) |
| ***B65C 5/02*** | (2006.01) |
| ***B65C 9/26*** | (2006.01) |
| ***B65D 23/08*** | (2006.01) |
| ***B65D 23/14*** | (2006.01) |

(52) U.S. Cl.

CPC ..... *B65C 9/02* (2013.01); *B65C 5/02* (2013.01); *B65C 9/0062* (2013.01); *B65C 9/26* (2013.01); *B65D 23/085* (2013.01); *B65D 23/14* (2013.01)

(58) Field of Classification Search

CPC ..... B65C 9/0062; B65C 9/02; B65C 9/26
USPC ..... 156/556, 567
See application file for complete search history.

(56) References Cited

U.S. PATENT DOCUMENTS

| | | | | |
|---|---|---|---|---|
| 5,259,913 | A * | 11/1993 | Stover | B65C 9/045 156/447 |
| 5,570,977 | A | 11/1996 | Simkowski et al. | |
| 5,709,770 | A | 1/1998 | Asghar et al. | |
| 2004/0099379 | A1* | 5/2004 | Erich | B65C 9/00 156/567 |
| 2004/0221546 | A1* | 11/2004 | Zwilling | B65C 9/0062 53/67 |

(Continued)

FOREIGN PATENT DOCUMENTS

| | | |
|---|---|---|
| DE | 10 2012 213 080 | 1/2014 |
| DE | 10 2013 215 638 | 2/2015 |

(Continued)

*Primary Examiner* — Philip Tucker
*Assistant Examiner* — John Blades
(74) *Attorney, Agent, or Firm* — Occhiuti & Rohlicek LLP

(57) ABSTRACT

A labeling device includes a container transporter that conveys the containers along a conveyor path and a first conveyor that runs between the return-stations. The labeling stations are arranged along the conveyor path between the return-stations. The frame's frame ends lie at opposite ends of a longitudinal axis. Attachment-sections associated with the frame ends attach to respective return stations, with at least one of them permitting attachment of a return-station at multiple positions along the axis. These attach to the mounts, which have continuous mounting-elements extending between the return-stations along the longitudinal axis. The mounts enable mounting a labeling station in any position between the return-stations using an attachment element that is complementary to the mounts and with which the labeling stations are equipped.

20 Claims, 10 Drawing Sheets

(56) References Cited

U.S. PATENT DOCUMENTS

| | | | | |
|---|---|---|---|---|
| 2006/0065356 | A1* | 3/2006 | Leykamm | B65C 3/00 156/250 |
| 2006/0265947 | A1* | 11/2006 | Siedlaczek | A01G 9/081 47/1.01 P |
| 2007/0034281 | A1* | 2/2007 | Brown | B65B 43/60 141/1 |

FOREIGN PATENT DOCUMENTS

| | | |
|---|---|---|
| DE | 10 2013 217 202 | 3/2015 |
| GB | 2 277 074 | 10/1994 |

* cited by examiner

PRIOR ART

LABELING DEVICE FOR CONTAINERS

RELATED APPLICATIONS

This application is a continuation of International Application PCT/EP2016/054236, filed on Feb. 29, 2016, which claims the benefit of the Mar. 12, 2015 priority date of German Application 10 2015 103 654.1, the contents of which are herein incorporated by reference.

FIELD OF INVENTION

The invention relates to a labeling device for containers, and in particular, these are currently constructed as rotary machines in which the containers are held during labeling by holders arranged around the periphery of a rotating transport wheel.

BACKGROUND

Known rotary labeling machines allow the labeling of containers, and especially of bottles, at a high throughput. One disadvantage of these devices is their lack of flexibility. For example, a rotary labeling machine can be rated for a certain throughput so that two labeling stations are arranged within its peripheral region. If during the course of use it becomes clear that the throughput has to be significantly increased then the length of the periphery of the rotary labeling machines imposes limits that make it difficult to increase throughput by providing more labeling stations.

An alternative to this would be to overdesign the labeling machine from the outset so that it offers subsequent scope for increasing capacity. For example, one can simply make the rotor larger. However, in addition to being more expensive, such a rotor would consume disproportionately more space because floor area increases as the square of the diameter.

An overdesigned labeling machine would also have a significantly greater amount of space that initially, at least, would be unused. Replacing a rotary labeling machine also necessitates a re-arrangement of all labeling stations that are already in use.

SUMMARY

The apparatus disclosed herein provides a labeling device that can be simply adapted to different capacities and that only needs a limited amount of space.

In one aspect of the invention, a labeling device comprises at least one transporter for containers, the transporter having at least one deflectable or flexible elongate endless-conveyor that circulates endlessly between at least two return stations and that comprises container holders. Such an endless conveyor can be configured, for example, as a link chain, a segmented conveyor, similar to a baggage conveyor at an airport, or as a conveyor belt. On the conveyor, holders are mounted to convey the containers along the conveyor's conveying path.

Each holder can comprise a head, such as neck-handling grippers or centering tulips. A neck-handling gripper grips a container, such as a bottle, further up in the region of the bottle's neck. A centering tulip centers a bottle from above in the horizontal plane only. In some but not all embodiments, the head has a motorized rotary drive to rotate a container about its vertical axis.

In some embodiments, a holder comprises a foot. An example of a foot is a round base, with or without a motorized rotary drive. A foot is usually mounted on a conveyor belt, a link chain, or a segmented conveyor. In some embodiments, it is useful to provide the round base with a rotary drive that can rotate a container, such as a bottle, about its axis. In those embodiments that have a centering tulip, the centering tulip rotates the bottle about its axis. This is particularly useful when labeling as the conveyor conveys the bottle.

The container transporter can comprise a plurality of conveyors. In some embodiments, one conveyor lies above another. In this arrangement the heads are preferably mounted on the upper conveyor while the feet are mounted on the lower conveyor. This makes it possible to grip or center a bottle in its upper region while supporting it in its lower region. In certain embodiments, the foot permits a bottle that it supports to also rotate.

The transport system comprises the conveyor, return stations, holders, and all peripheral elements that are necessary for operation. These peripheral elements include, for example, sensors, switches, control elements, and electronics.

The labeling device has at least one inlet/outlet region for feeding and discharging containers to and from the conveyor. The inlet and outlet regions can be disposed at different locations but are preferably provided at one location, preferably in the region of a return station. An inlet/outlet device, for example an inlet/outlet star by way of which the labeling device controls the feeding and discharge of containers, is preferably arranged in the inlet/outlet region. However the inlet/outlet region can only comprise guides, in which case the feeding and discharging of containers is effected by feeding/discharge devices that are separate from the labeling device. If the labeling device comprises its own inlet/outlet device, as is the case with an inlet/outlet star, then the latter is arranged in the region of a return station because the inlet star and the outlet star can be arranged relatively close to one another without interfering with each other. This enables them to transfer the containers from a conveyor belt to the conveyor of the labeling device and then back to the conveyor belt. The labeling device also comprises at least one labeling station, preferably at least two labeling stations arranged in the region along the conveyor path of the conveyor between the two return stations.

The terms "endless conveyor" and "conveyor" are used synonymously. The term "container" refers in particular to containers used to hold drinks or paste-like materials, and bulk materials. Examples of containers include bottles, PET bottles, party cans, and kegs.

Some embodiments feature an arrangement of labeling stations along the linear region of a conveyor comprising an elongate endless conveyor that runs between at least two return stations. An advantage of this feature is that the labeling device can be adapted in size and hence in throughput according to requirements.

At the beginning, for example, the distance between the return stations can be two meters, making a linear arrangement region for labeling stations and other container treatment stations of a total of four meters. If more labeling stations are required, the distance between the two return stations is increased and the existing endless conveyors can simply be replaced by longer endless conveyors, or even more simply, lengthened. In the course of doing so, the size of the additionally created linear region of the conveyor for arranging additional labeling stations increases twice as much as the increase in distance between the two return stations. If, for example, the distance between the return stations is increased from two to three meters, then we obtain in total a linear arrangement region of six meters for labeling stations and other container-treatment stations, i.e. an increase of two meters.

An apparatus as described herein permits a simple linear extension to significantly increase the possibilities for arranging further labeling stations and further container-treatment stations. This results in only a linear increase in the overall size of the labeling device, and not a quadratic increase as is the case in a rotary machine.

An additional advantage of this construction is that extant labeling stations remain in their places. They do not have to be re-assembled. The space needed for a linear labeling device is therefore much smaller than it would be for an equivalent rotary machine.

The conveyor need not be arranged in a straight line. It can, for example, go around corners. In such cases, deflectors, such as chain wheels or corresponding guides, are disposed at the deflector points to change the direction of the conveyor at a break point in the horizontal plane. This makes it possible to have different linear conveying regions at different angles relative to each other. This is particularly useful for installation in a factory building that does not have a sufficiently long linear region.

The simplest, least complex arrangement of a labeling device is a linear alignment of the transporter in which the endless conveyor runs between two return stations so that the conveyor runs linearly, i.e. uniaxially, between the two return stations as a drawn-out closed loop. Here, a right-hand conveyor section and a left-hand conveyor section of a conveyor loop runs in opposite direction and offer possible layout positions for labeling stations and for other container treatment stations as may be necessary.

The two return stations can be attached to separate frames on the floor of a building, in which case the inter-frame and/or the position of the return station on at least one of the frames is adjustable relative to the other frame.

Preferably, however, the return stations are arranged on a single frame that has attachment sections for the two return stations, preferably in the region of its two ends. At least one attachment section, and possibly also both attachment sections of the frames will preferably permit an attachment of the associated return station in a plurality of positions along the frame's longitudinal axes. The distance between the two return stations attached to the frame can be adjusted as desired so that the length of the labeling device can be increased or reduced as required.

In some embodiments, the frame has mounting devices for the attachment of at least one, and preferably at least two labeling stations. This enables the labeling stations to be attached to the frame such that forces occurring between the labeling station and the conveyor can be satisfactorily transmitted. The position of the labeling station relative to the conveyor path of the conveyor is also precisely defined. This is important for accurate labeling.

In some embodiments, the frame comprises at least one continuous mounting element extending in the frame's longitudinal direction between the return stations, for example, as a section/rail running in the longitudinal direction. This mounting element allows the mounting of labeling stations and other container treatment stations in any desired positions between the return stations. For this purpose the labeling stations and other container treatment stations comprise attachment elements, such as flanges or clamping jaws, that are complementary to the mounting element. The arrangement of the labeling stations and other container treatment stations between the return stations can therefore be selected with total freedom, allowing a very individual adaptation of the machine design to suit different requirements. Optimum use can also be made of the available space by arranging the labeling stations and any other container treatment stations as closely as possible one after another on the conveyor path.

The distance between the two return stations of the conveyor is preferably adjustable so that the length of the conveyor can be increased or reduced. In this way the length of the conveyor can be adjusted as required based on the distance between the return stations without having to replace the entire conveyor.

Some embodiments rely on a link element chain or an arrangement of link elements. In these embodiments, the links can be detachably connected at at least one point in the chain. This enables additional links to be fitted or removed at that point.

The frame preferably comprises at least two frame parts that are longitudinally adjustable relative to one another and on which the return stations are arranged. The distance between the return stations can be easily adjusted in this way. Such frame parts can be longitudinal sections that slide against one another like rails and that can be fixed in any desired position. Alternatively, the frame can comprise frame parts that can be fitted or removed. The distance between the return stations can be quickly and simply adjusted in this way.

Preferably at least two of the frame parts each carry a return station so that when the frame parts are adjusted relative to one another the distance of the return stations relative to one another is also adjusted.

In the conveyor, at least one of the return stations is driven. This has the advantage that a separate drive need not be provided in the region of the linear conveyor path of the conveyor, which in turn would restrict access to the conveyor path for labeling stations or other container treatment stations.

A plurality of labeling stations is preferably arranged between the return stations along the endless conveyor so that the throughput of the labeling device can be increased accordingly.

Each return station preferably comprises at least one guide wheel that engages with the conveyor. In the case of a link chain, the guide wheel can be configured in the manner of a chain pinion for example. If in this case the return station is also preferably driven, then on the one hand a very defined drive of the conveyor can be achieved and on the other the drive is accommodated in a region in which it does not restrict access to the conveyor path.

In some embodiments, the holders are configured by heads for holding the containers in their upper region and/or feet for holding the containers in their lower region. Since heads grip the containers more in the container's upper region, it is an advantage in this case if the associated conveyor is positioned further upward relative to the conveyed containers. If the holders are configured as feet, the conveyor is preferably positioned further down and is preferably configured as a segmented conveyor. Then each segment can be provided with at least one foot, for example a round base that has its own rotary drive, in order to rotate the containers about their own axis. In this case the conveyor is preferably positioned in the lower region, i.e. in the region of the base of the container. If both heads and feet are provided, they can be held either by a common conveyor and/or by separate conveyors. In either case it is advantageous if the distance between the head and foot is adjustable.

This enables containers of different heights to be handled with the conveyor of the labeling device.

In some embodiments, the head and/or feet are held detachably on the conveyor. This facilitates easy replacement of head and/or feet should they be faulty or worn. It also facilitates quick mounting of different heads and/or feet for different containers on the conveyor. This promites rapid retooling of the labeling device for different containers.

In principle, it is also possible to have different holers arranged on the conveyor, as a result of which containers can be processed at different labeling stations.

In an especially advantageous embodiment, the head is a combination head that comprises a neck-handling gripper as well as a centering tulip. In this case the head is held on the conveyor so as to be adjustable, e.g. so that it can rotate, such that optionally either the neck handling gripper or the centering tulip can engage with the conveyed containers. In some embodiments, the neck-handling gripper and the centering tulip are arranged square to a shaft that is held on the conveyor so as to be able to rotate about a horizontal axis. This rotation can be motorized. Either the centering tulip or the neck handling gripper engages with the container by simple rotation of the shaft through 180°. The centering tulip can have its own rotary drive by which it, together with the gripped bottle, can be set in a rotary motion that may be necessary for the labeling operation. The combination head can interact with a corresponding foot, for example a round base, in particular a turntable.

In some embodiments, a labeling station is a hot-melt adhesive labeling station for processing labels "from the sheet," and arranged in the peripheral region of a return station. Since hot-melt adhesive labeling stations are preferably arranged on carousels of small diameter because of their particular label-removal kinematics, arrangement in a peripheral region of a return station promotes correct label removal more effectively than it would if they were arranged in the linear section of the conveyor path between two return stations.

The following labeling/treatment stations can for example be arranged in a labeling device of the type referred to above: cold-melt adhesive labeling stations, hot-melt adhesive labeling stations from sheet or roll, roll-fed stations, printing devices such as for example inkjet printers, inspection devices, monitoring cameras, and aligning units.

All of these labeling stations or container treatment stations promote the correct fixing of printed matter, whether on a label or directly on the bottle.

It is preferable if guide devices that control the position of the conveyor in the horizontal plane square to the conveyor direction are arranged in the course of the conveyor path between the return stations. Such a guide device can be a rail in or on which the conveyor runs. This is important in order to control the position of the conveyed container relative to the labeling station.

In some embodiments, a labeling device as described herein has two conveyors that are vertically offset so that one lies above the other. In such embodiments, the upper conveyor carries heads that grip the upper regions of containers and the lower conveyor carries feed that support the lower regions of containers. The head can include, for example, a centering tulip or neck-handling gripper. The feet can include round bases or turntables. By attaching a container to both of these conveyors, it becomes possible to precisely define bottle position along the conveyor path and to exactly align containers at labeling stations.

In some embodiments, the distance between the head and foot of a holder is adjustable. This allows the holder to accommodate different sizes of containers.

Also among the embodiments are those in which the labeling device is rapidly switchable between container-handling techniques. For example, one can switch between neck handling and base handling as needed. In neck handling, the foot could be moved down far enough to allow the container to be freely suspended. For base handling, one would lower a centering tulip onto the head and then adjust the foot level to support the container bases on a transport plane defined by the conveyor.

In general, the holders require energy from an external source to operate. This can be provided by, for example, rotary transmitters, drag chains, sliding contacts, rotary distributors and radio transmitters/receivers. These can also be used to transmit signals between a controller and the holders.

An apparatus as described herein provides increased component standardization and simple expandability. As a result of the apparatus, it becomes simpler to increase the length of moving conveyors and to deploy additional guide elements or rotationa elements. The apparatus also promotes flexibility in configuring a labeling device to accommodate different types of container.

Height-adjustable centering arrangements are preferably provided for the containers at the head and/or foot. These permit the containers to be accurately centered relative to the holders. In some embodiments, the head and foot define a single unit that can be attached to just one conveyor. In other embodiments, head and feet of the holder are carried by separate conveyors. In either case, there are embodiments in which the distance between the head and foot is adjustable.

In some embodiments, the conveyor is divided into a left-hand conveyor section disposed to the left of the two return stations and a right-hand conveyor section disposed to the right of the two return stations. These two conveyor sections move in opposite directions. The labeling stations, as well as any other processing stations, can be arranged between these two conveyor sections and/or outside the conveyor sections. This enables a large number of possible machine designs. It also permits the flexibility to place more labeling stations in a given space, thus optimizing use of space.

If the diameter of the two return stations is the same, then the two linear counter-rotating conveyor sections run parallel to one another. On the other hand, if they are not the same, the two conveyor sections run at an acute angle relative to one another. This promotes further flexibility in overall design device, thus promoting the ability to optimally use the space within a building.

The term "labeling station" also includes printing stations that print information directly on a container instead of fixing a label with information onto the container. The invention therefore also extends to cover printing devices without labels.

In another aspect, the invention includes a method for adapting the handling capacity of a labeling machine. Such a method includes opening the conveyor, changing the distance between the two return stations, increasing or decreasing the length of the conveyor to match the changed distance between the return stations, and changing the number of labeling stations according to the changed distance between the return stations.

The capacity of a labeling device can be easily matched to changing requirements in this way.

BRIEF DESCRIPTION OF THE DRAWINGS

The invention is described below by way of example with reference to the schematic drawings, in which.

Parts that are identical or that have the same function are indicated by identical reference signs in all the figures.

DETAILED DESCRIPTION

Figure 1:
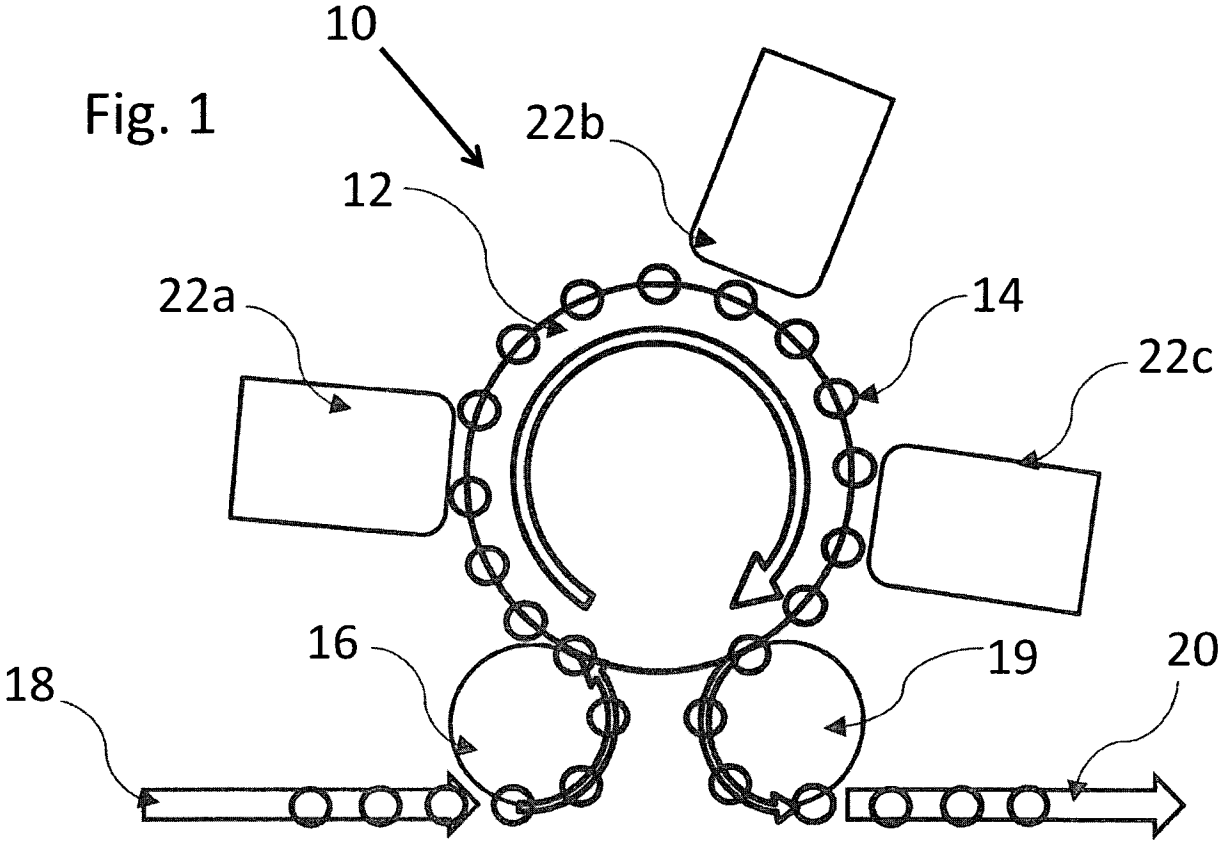
FIG. 1 shows a a rotary labeling machine.

FIG. 1 shows a rotary labeling device 10 comprising a rotating conveyor wheel 12 on the periphery of which containers 14 are held in vertical position in holders. The containers 14 are fed to conveyor wheel 12 from a feeder belt 18 via an inlet star 16. The labeled containers are transferred from the conveyor wheel 12 to a discharge belt 20 via an outlet star 19.

In this example, three labeling stations 22*a*, 22*b*, 22*c* are arranged around the periphery of conveyor wheel 12 so that it is possible to achieve a certain throughput that ultimately depends on the treatment length available behind each labeling station 22*a*, 22*b*, 22*c*. Each labeling station 22*a*, 22*b*, 22*c* can be configured as a hot-melt, a cold-melt adhesive labeling station, or as a printing station that applies text or images directly onto the bottle.

A disadvantage of the device shown in FIG. 1 is that its throughput is limited. In the event of a product changeover, a larger conveyor wheel 12 must be used. This usually requires a completely new installation. Moreover, since the conveyor wheel's footprint depends on the square of its diameter, increasing the wheel's diameter will disproportionately increase its footprint. This will then require a re-arrangement of all essential components of the labeling device, for example of all the labeling stations.

Figure 2:
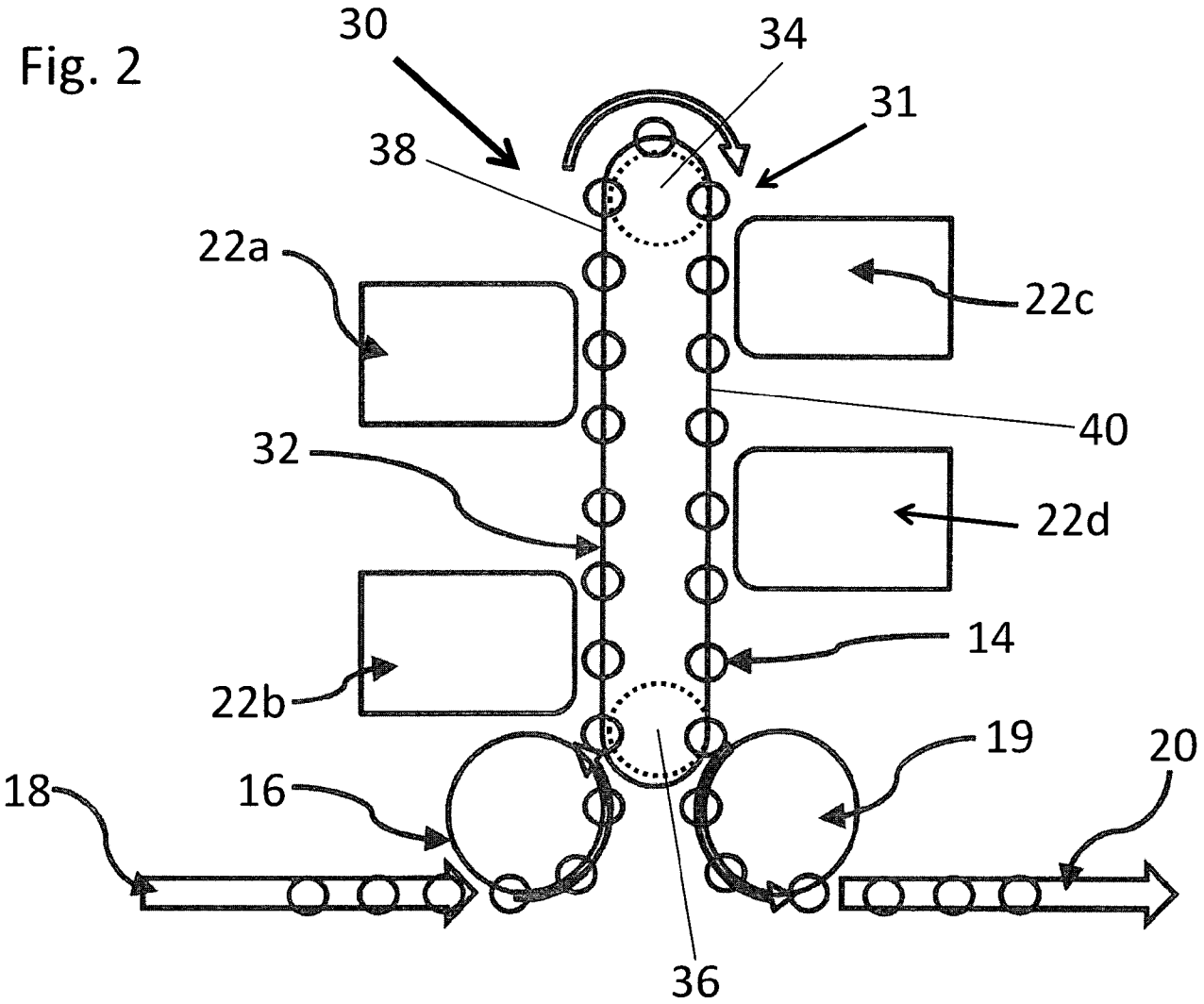
FIGS. 2-5 embodiments of a linear labeling device.

FIG. 2 shows an alternative labeling device 30 having a container transporter 31 that includes a flexible endless-conveyor 32 circulating between first and second return-stations 34, 36 thereof. The holders for the containers 14 are arranged at equal distances on the conveyor 32. Examples of a conveyor 32 include a conveyor chain, a link belt, or segmented-conveyor belt.

The first and second return-stations 34, 36 have circular guide wheels over which the conveyor 32 runs. Preferably, at least one of the first and second return-stations 34, 36 is driven.

An inlet star 16 and an outlet star 19 are arranged near each other in a region of the second return-station 36. The inlet star feeds containers 14 from a feeder belt 18. The outlet star 19 transfers containers to a discharge belt 20.

The conveyor 32 has a left and right linear-sections 38, 40. The left linear-section 38 runs to the left of the first and second return-stations 34, 36. The right linear-section 40 runs to the right of the first and second return-stations 34, 36. The left and right linear-sections 38, 40 move in opposite directions. Although the whole container transporter 31 takes up comparatively little space, a total of four labeling stations 22*a*-22*d* are arranged next to the left and right linear-sections 38, 40. Although the left and right linear-sections 38, 40 are shown running in one direction, this can be reversed.

Figure 3:
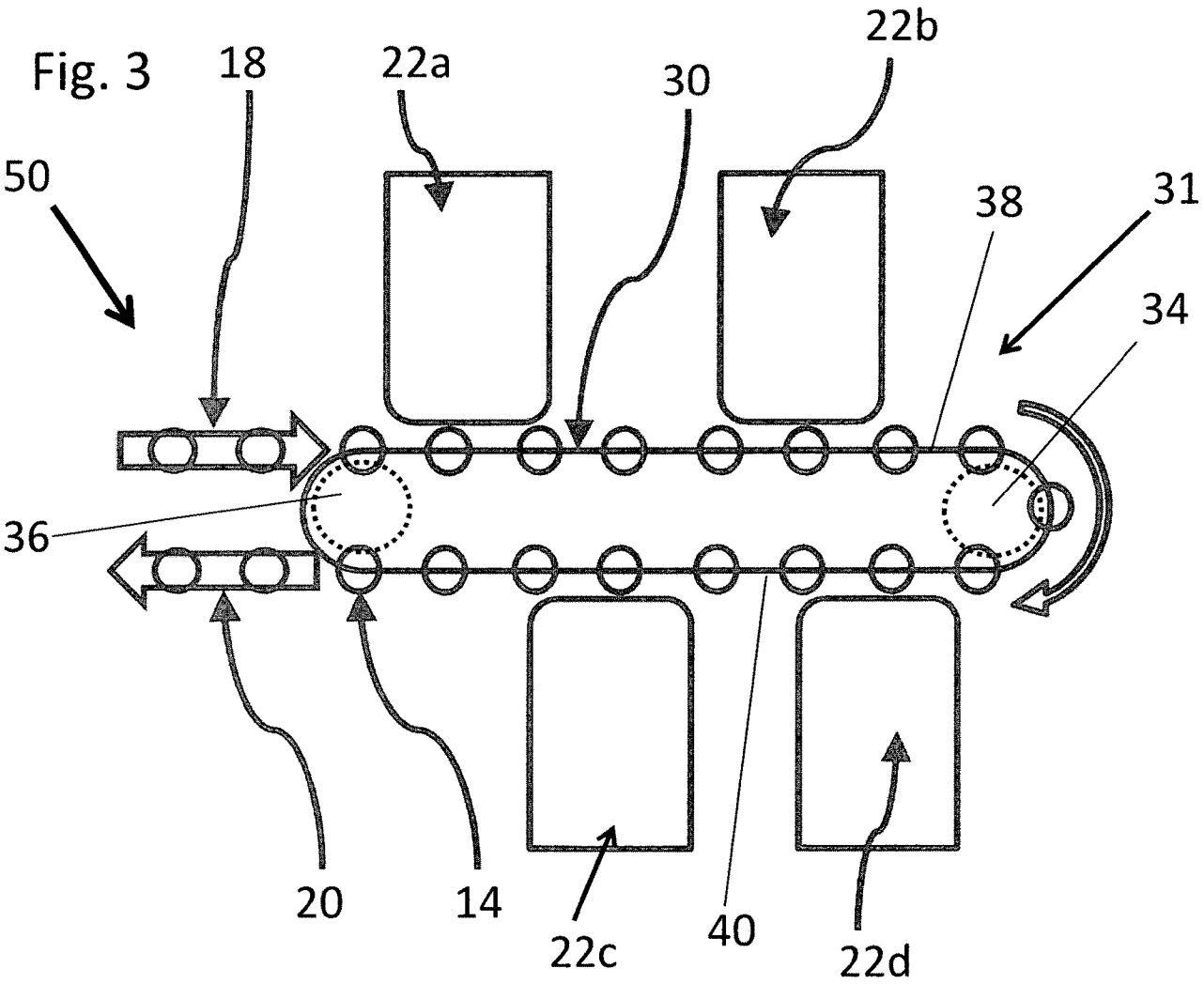

FIG. 3 shows a second embodiment of a labeling device 50 that is configured very much like the labeling device 30 in FIG. 2. Unlike the labeling device 30 of FIG. 2, the feeder belt 18 forms the inlet device and the discharge belt 20 forms the outlet device, with neither of them being necessarily part of the labeling device 50. Guides located in the inlet and outlet regions of the second return-station 36 promote transfer between the feeder and discharge belts 18, 20 and the container transporter 31.

Figure 4:
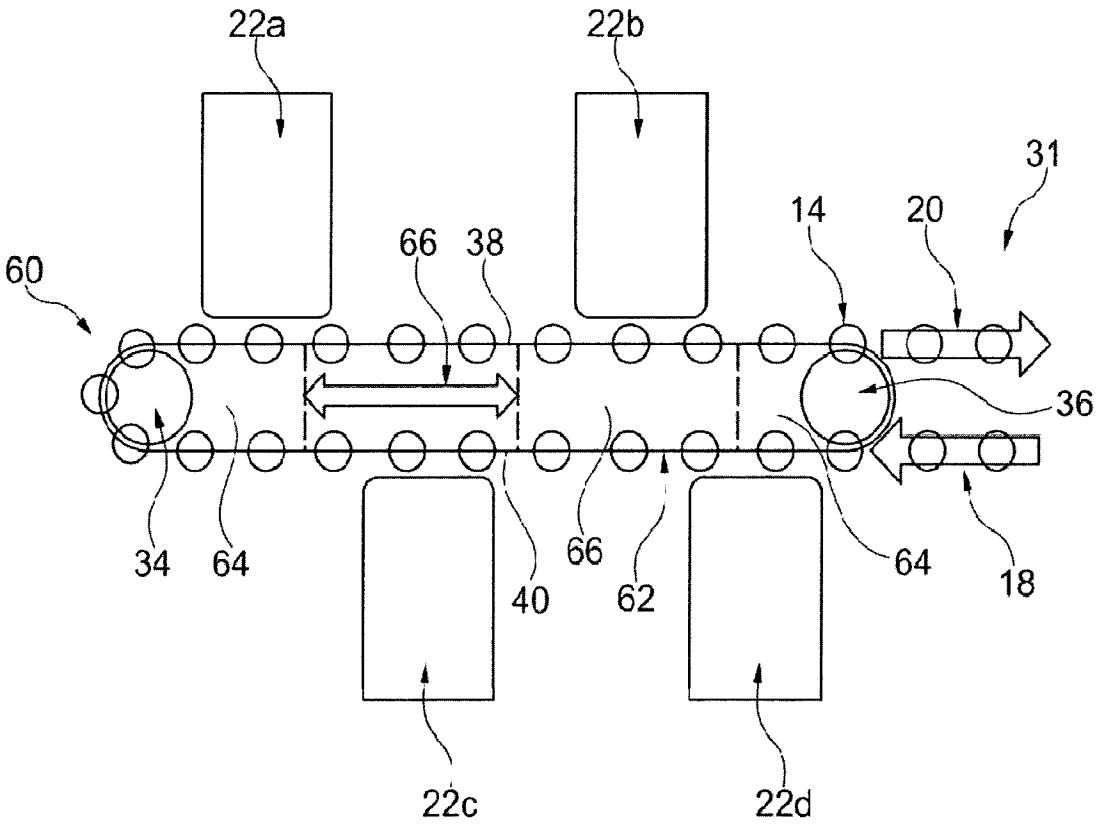
Figure 5:
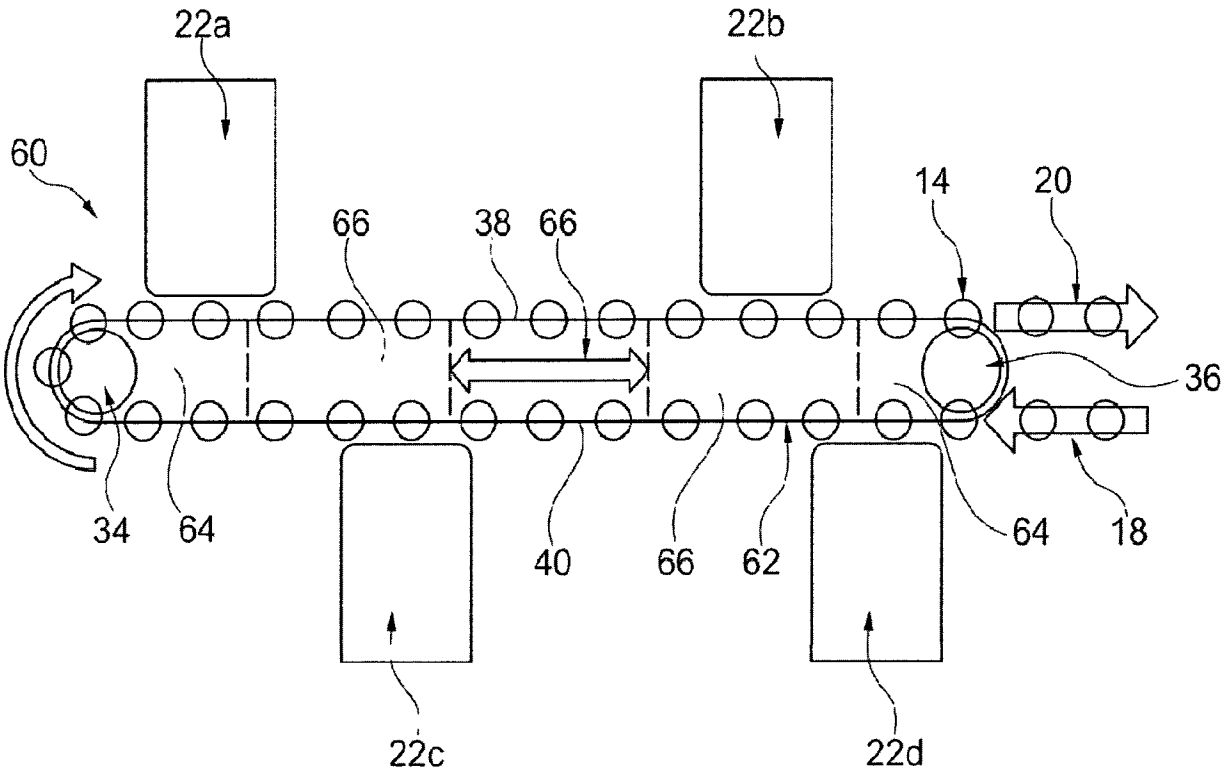

FIGS. 4 and 5 show a third embodiment 60 of a labeling device. In this third embodiment 60, a frame 62 holds the first and second return-stations 34, 36. This frame 62 comprises outer frame-parts 64 and inner frame-parts 66 that are axially connected to the outer frame-parts 64. The outer frame-parts 64 each carry a return-station 34, 36. The inner frame-parts 66 hold the two outer frame-parts 64 at a defined distance. In FIG. 4, the labeling device 60 has two inner frame-parts 66. In FIG. 5, the labeling device 60 has three inner frame-parts 66. This makes the overall frame 62 in FIG. 5 longer.

An endless conveyor 68 of the labeling device 60 has an adjustable length. In some embodiments, the conveyor 68 is a link chain, in which case length adjustment involves adding and removing links. The ability to add or remove links permits the endless conveyor 68 to match the different lengths of the frames shown in FIGS. 4 and 5. The embodiment of the labeling device 60 shown in FIGS. 4 and 5 can thus be easily adjusted to a desired size in this way.

It is also possible to adjust the length of the conveyor in the devices depicted in FIGS. 2 and 3. It is also possible, in lieu of adjusting a belt length, to simply use a new conveyor that is longer or shorter. Although this is more difficult than inserting or removing links, it is still a mere fraction of the effort needed to change the diameter of a rotating conveyor.

Figure 6:
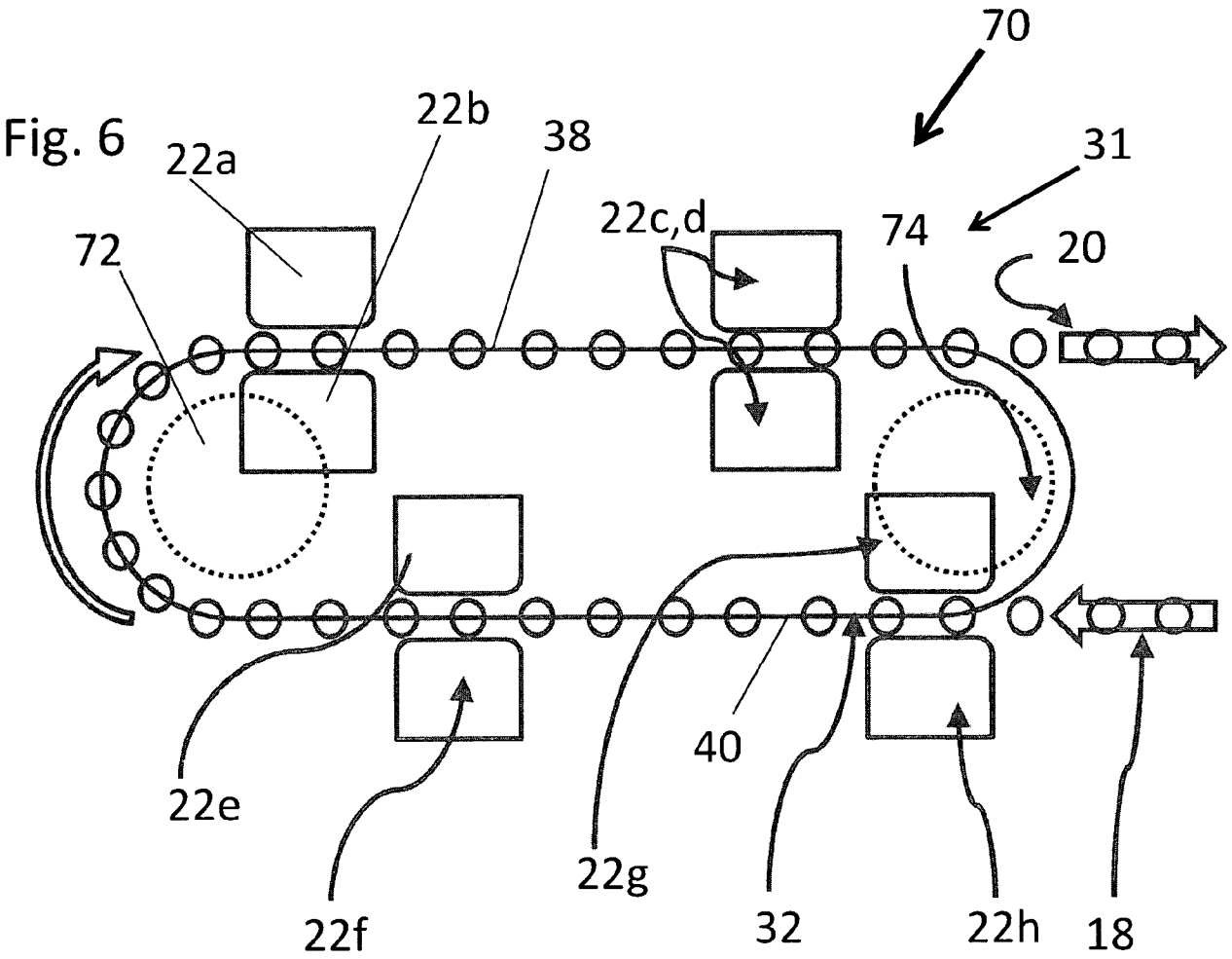
FIG. 6 shows a labeling device having labeling stations arranged on both sides of a conveyor, FIG. 7 showspart of an endless conveyor having heads for holding bottles with integrated container rotating and swiveling drives.

FIG. 6 shows a fourth embodiment 70 of a labeling device in which the labeling stations are arranged not only on the outside of the first and second linear-sections 38, 40 of the conveyor 32 but also between them. In this way more labeling stations, in the present case eight labeling stations 20*a*-20*h*, can be arranged within a given length of the labeling device. In this embodiment it is an advantage if the first and second return-stations 72, 74 have a somewhat greater radius than in the previous embodiments in which labeling stations 22*a*-22*d* are only arranged outside the conveyor 32. This greater radius results in a small increase in the overall width of the labeling device.

In the embodiment of FIG. 6, it is preferable that the labeling stations located within the inner region be those that require minimal intervention by operator personnel. Accordingly it is particularly advantageous that printing, aligning, dating, or inspection systems be arranged within the inner region.

Figure 7:
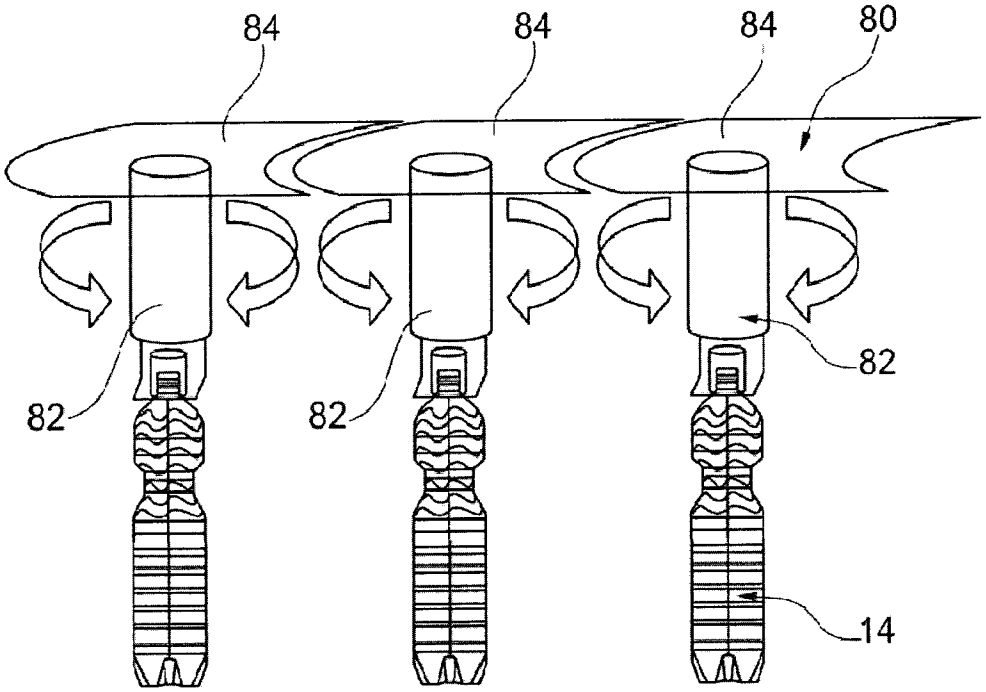

FIG. 7 shows a section of an upper endless-conveyor 80 that is configured as a segmented conveyor having a plurality of segments 84 connected to one another such that they are able to swivel. A neck-handling gripper 82 that suspends a bottle-shaped container 14 by its neck is mounted on each segment 84 as a holder. A rotary drive holds each neck-handling gripper 82 on its associated segment 84 such that the neck-handling gripper 82 can rotate. In this embodiment of a conveyor 80, the bottles are conveyed suspended.

Figure 8:
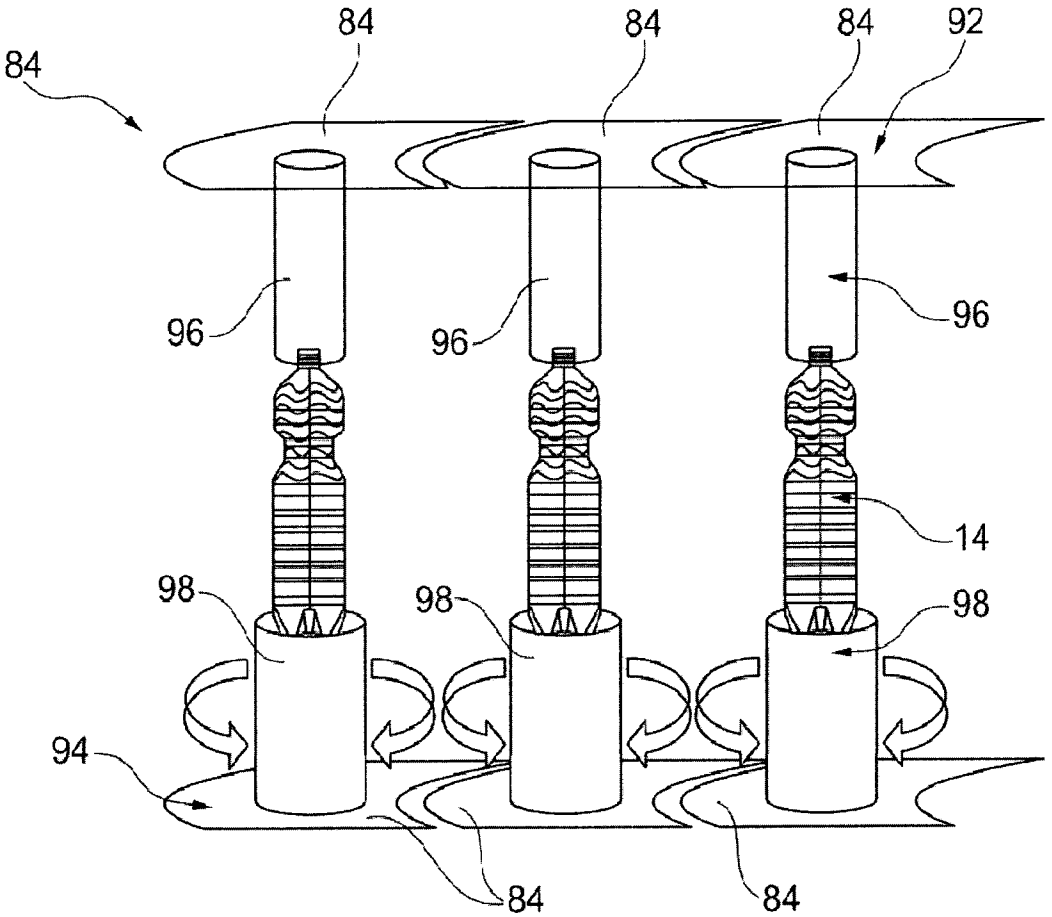
FIG. 8 shows part of two conveyors arranged one above the other having heads as well as feet for rotating and holding bottles.

FIG. 8 shows a conveyor 90 having an upper segmented-conveyor 92 and a lower segmented-conveyor 94, each of which has segments arranged one above the other. Each segment 84 of the upper segmented-conveyor 92 contains, as holders, centering tulips 96 for the centering of the top of a bottle 14.

Meanwhile, each segment 84 of the lower segmented-conveyor 94 comprises, as its holder, a round base 98 with a motorized rotary drive. Since the upper segmented-conveyor 92 and the lower segmented-conveyor 94 are driven together by the first and second return-stations 34, 36, they move synchronously with one another. This means that the bottles 14 remain vertical in every conveyor position. To withdraw or feed the bottles 14, one simply increase the distance between the centering tulips 96 and the round bases 98. This is carried out using guide baffles that engage with the corresponding holders 96, 98 or with the actual upper and lower segmented-conveyors 92, 94.

Figure 9:
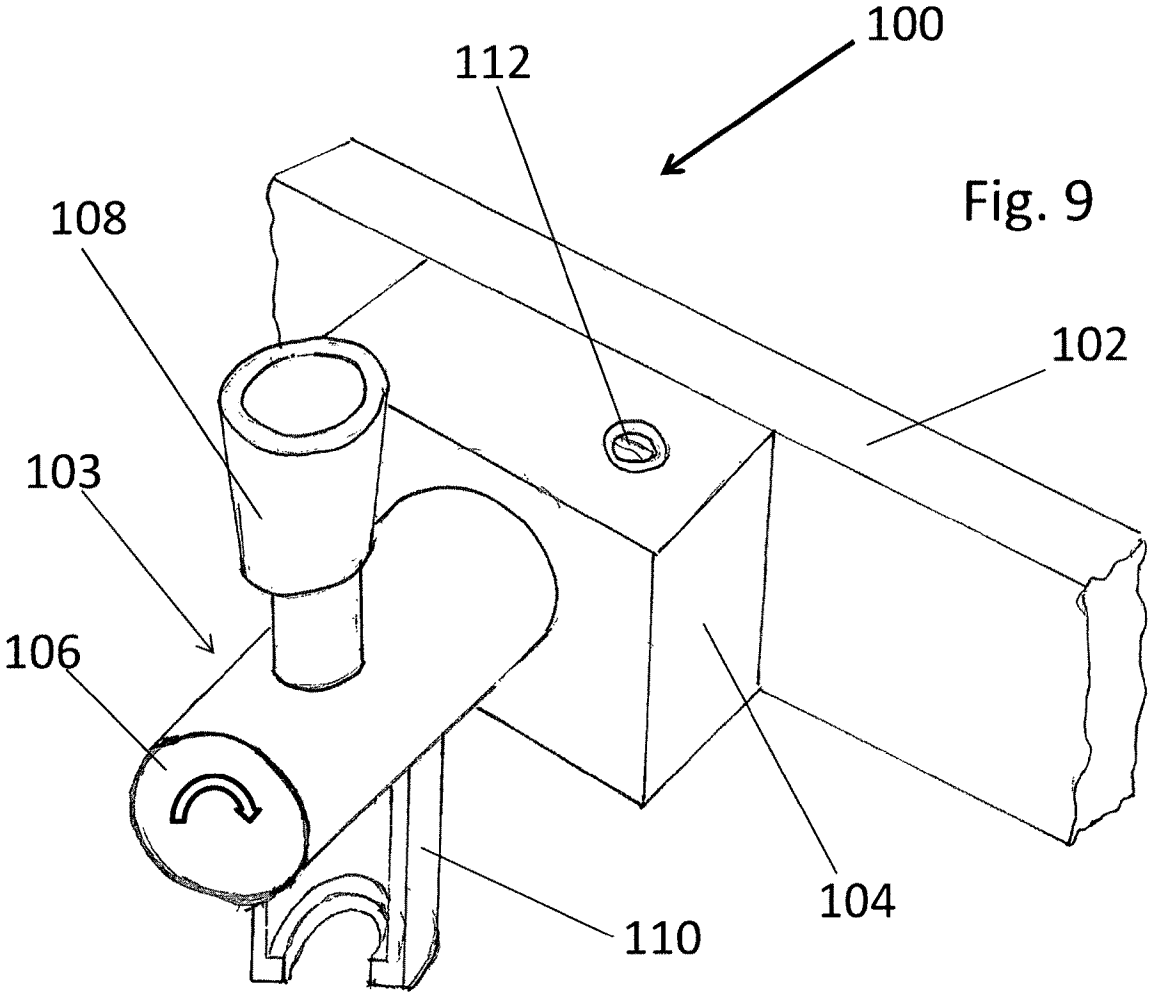
FIG. 9 shows a part of a conveyor having a combination head that contains a centering tulip as well as a neck-handling gripper.

FIG. 9 shows part of a link 102 of a conveyor 100 in which the links 102 are interconnected by vertically running swivel links. Each link 102 of the conveyor 100 contains a mounting 104 in which a rotary drive is arranged and in which a shaft 106 is mounted so that it can swivel about a horizontal axis, preferably by 180°. The shaft 106 and the mounting 104 together form the support section of a combination head 103. On one side of the shaft 106 and at right angles to its axis of rotation is a centering tulip 108. On the opposite side of the shaft 106 is a neck-handling gripper 110.

By actuating the rotary drive in the mounting 104, the shaft 106 can be turned so that either the neck-handling gripper 110 points down, as shown in FIG. 9, or the centering tulip 108 points down. The centering tulip 108 can also be driven to rotate about its own axis by its motorized drive.

A locking screw 112 releases the shaft 106 to allow a replacement shaft or another head to be mounted. The locking screw 112 is preferably arranged in the mounting 104. Using the depicted combination head 103, it is possible to convey a bottles while holding it at the top, in which case the bottle is suspended, or by centering at the top and supporting it from below on a round base of a foot.

Figure 10:
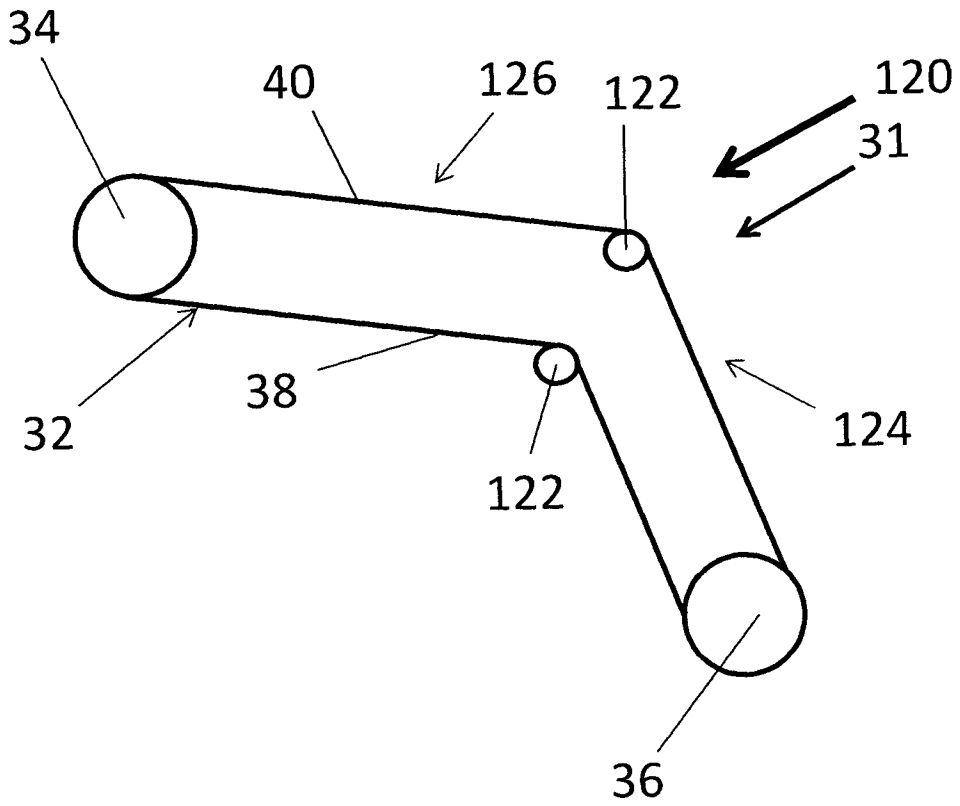
FIG. 10 shows a diagonally running conveyor.

FIG. 10 shows the possible configuration of a further embodiment 120 of a labeling device having conveying sections that run at different angles relative to each other. For clarity, the labeling stations themselves have been omitted.

Unlike the previously depicted container transporter 31, which runs linearly, the conveyor 32 of FIG. 10 runs between the first and second return-stations 34, 36 via guides 122. The conveyor 32 thus comprises a first linear-section 124 that is inclined relative to a second linear-section 126 by any desired angle. A suitable range of angles is from 0-120°. This configuration is useful when there is not enough space to accommodate a purely linear labeling device.

It has so far been generally assumed that the first and second return-stations 34, 36; 72, 74 are configured as star wheels that both guide and mechanically drive the conveyor 32. However, the first and second return-stations 34, 36; 72, 74 can also be executed in other ways.

For example, the first and second return-stations 34, 36; 72, 74 can be implemented as rigid guide tracks that do not circulate but that only guide the conveyor 32. In such an embodiment, separate drive motors that are arranged inside the device guide the conveyor 32.

Using an apparatus as described herein considerably reduces the space required by labeling machines that have a plurality of labeling stations. This makes it possible to provide complete and set-up labeling stations for a plurality of different labeling decorations at a labeling machine, in turn making it possible to change over from one container decoration to another container decoration without any set-up time, or at least with a significantly reduced set-up time.

Having described the invention, and a preferred embodiment thereof, what is new and secured by Letters Patent is:

1. A labeling device for labeling containers, said labeling device comprising a conveyor for the containers, the conveyor having at least one deflectable endless elongate conveyor element that runs between at least two return stations and that comprises holding elements for the containers, wherein said labeling device comprises an inlet/outlet region for the feeding and discharging of containers to and from the conveyor, with at least one labeling station being arranged along the conveyor path of the conveyor element between two of the return stations, an elongate frame that comprises, in a region of its two ends, attachment sections for the at least two return stations, wherein at least one attachment section allows an attachment of the associated return station in multiple positions along the longitudinal axis of the frame, wherein the frame comprises mounting devices for the attachment of at least two labeling stations, wherein the mounting devices are configured as at least one continuous mounting element that extends between the return stations in the longitudinal direction of the frame and that allows mounting in any desired position between the return stations by way of attachment elements that are complementary to the mounting element, and wherein the device comprises different container treatment stations having attachment elements that are complementary to the mounting element.

2. The labeling device of claim 1, wherein the conveyor element is adjustable in length and the distance between at least two of the return stations of the conveyor is adjustable.

3. The labeling device of claim 1, wherein the frame comprises at least two frame parts arranged one after the other longitudinally, and wherein the frame parts are at least one of variable in number and adjustable relative to one another.

4. The labeling device of claim 3, wherein at least two of the frame parts each carry at least one return station.

5. The labeling device of claim 1, wherein the inlet/outlet region comprises an inlet/outlet device that is configured as an inlet/outlet star.

6. The labeling device of claim 5, wherein the inlet/outlet device is arranged in the region of a return station.

7. The labeling device of claim 1, wherein at least one of the return stations is driven.

8. The labeling device of claim 1, wherein a plurality of labeling stations is arranged along the conveyor element between the return stations.

9. The labeling device of claim 1, wherein each return station comprises at least one guide wheel that engages with the conveyor element.

10. The labeling device of claim 1, wherein the holding elements comprise head and/or foot elements for holding the head and/or foot region of containers.

11. The labeling device of claim 10, wherein a vertical position of the head and/or foot elements is adjustable.

12. The labeling device of claim 10, wherein head and/or foot elements are held detachably on the conveyor element.

13. The labeling device of any of claim 10, wherein a head element is configured as a combination head element that comprises a neck handling gripper and a centering tulip, wherein said combination head element is held adjustably and rotatably on the conveyor element so as to enable at least one of the neck handling gripper and the centering tulip to engage with the transported containers.

14. The labeling device of claim 1, wherein at least one labeling station is configured as a hot-melt adhesive labeling station that is arranged in a peripheral region of a return station.

15. The labeling device of claim 1, wherein the at least one labeling station comprises one or a plurality of the following labeling stations arranged in the region of the conveyor element: cold-melt adhesive labeling stations, hot-melt adhesive labeling stations, printing stations, inspection stations, monitoring cameras, and aligning units.

16. The labeling device of claim 1, further comprising guide devices that control the position of the conveyor element in the horizontal plane transverse to the conveyor direction, the guide devices being arranged in the path of the conveyor element between the return stations.

17. The labeling device of claim 1, further comprising an additional conveyor arranged vertically above the first conveyor, wherein the additional conveyor element is an upper conveyor element that carries head elements that grip the containers in their upper region, and wherein the conveyor is a lower conveyor element that carries foot elements that support the containers in their lower region.

18. The labeling device of claim 17, wherein a vertical distance between head elements and foot elements is adjustable.

19. The labeling device of claim 1, wherein a plurality of labeling stations is arranged inside counter-rotating conveyor element sections of the conveyor element.

20. The labeling device of claim 1, wherein a plurality of labeling stations is arranged on the outsides of counter-rotating conveyor element sections of the conveyor element.

* * * * *